US009857708B2

(12) United States Patent
Wosnick et al.

(10) Patent No.: US 9,857,708 B2
(45) **Date of Patent: *Jan. 2, 2018**

(54) TONER COMPOSITIONS AND PROCESSES

(75) Inventors: Jordan H. Wosnick, Toronto (CA); Valerie M. Farrugia, Oakville (CA); Guerino G. Sacripante, Oakville (CA)

(73) Assignee: Xerox Corporation, Norwalk, CT (US)

( * ) Notice: Subject to any disclaimer, the term of this patent is extended or adjusted under 35 U.S.C. 154(b) by 94 days.

This patent is subject to a terminal disclaimer.

(21) Appl. No.: 13/094,065

(22) Filed: Apr. 26, 2011

(65) Prior Publication Data

US 2012/0276477 A1 Nov. 1, 2012

(51) Int. Cl.
*G03G 9/087* (2006.01)

(52) U.S. Cl.
CPC ..... *G03G 9/08755* (2013.01); *G03G 9/08782* (2013.01); *G03G 9/08795* (2013.01); *G03G 9/08797* (2013.01)

(58) Field of Classification Search
CPC ..... G03G 9/08755; G03G 9/08797; G03G 9/08795; G03G 9/08782
USPC ..... 430/109.4, 109.1, 123.54
See application file for complete search history.

(56) References Cited

U.S. PATENT DOCUMENTS

| | | | | |
|---|---|---|---|---|
| 3,590,000 | A | 6/1971 | Palermiti et al. | |
| 3,847,604 | A | 11/1974 | Hagenbach et al. | |
| 4,295,990 | A | 10/1981 | Verbeek et al. | |
| 4,298,672 | A | 11/1981 | Lu | |
| 4,338,390 | A | 7/1982 | Lu | |
| 4,935,326 | A | 6/1990 | Creatura et al. | |
| 4,937,166 | A | 6/1990 | Creatura et al. | |
| 5,236,629 | A | 8/1993 | Mahabadi et al. | |
| 5,278,020 | A | 1/1994 | Grushkin et al. | |
| 5,290,654 | A | 3/1994 | Sacripante et al. | |
| 5,302,486 | A | 4/1994 | Patel et al. | |
| 5,308,734 | A | 5/1994 | Sacripante et al. | |
| 5,330,874 | A | 7/1994 | Mahabadi et al. | |
| 5,344,738 | A | 9/1994 | Kmiecik-Lawrynowicz et al. | |
| 5,529,873 | A | 6/1996 | Chiba et al. | |
| 5,948,584 | A * | 9/1999 | Hashimoto et al. | 430/109.3 |
| 5,959,066 | A | 9/1999 | Charbonneau et al. | |
| 6,025,061 | A | 2/2000 | Khanarian et al. | |
| 6,063,464 | A | 5/2000 | Charbonneau et al. | |
| 6,063,827 | A | 5/2000 | Sacripante et al. | |
| 6,107,447 | A | 8/2000 | Kreuder et al. | |
| 6,214,507 | B1 | 4/2001 | Sokol et al. | |
| 6,593,049 | B1 | 7/2003 | Veregin et al. | |
| 6,743,559 | B2 | 6/2004 | Combes et al. | |
| 6,756,176 | B2 | 6/2004 | Stegamat et al. | |
| 6,830,860 | B2 | 12/2004 | Sacripante et al. | |
| 7,029,817 | B2 | 4/2006 | Robinson et al. | |
| 7,329,476 | B2 | 2/2008 | Sacripante et al. | |
| 7,629,098 | B2 * | 12/2009 | Matsumura et al. | 430/109.4 |
| 2006/0216626 | A1 | 9/2006 | Sacripante et al. | |
| 2006/0222991 | A1 | 10/2006 | Sacripante et al. | |
| 2007/0015075 | A1 | 1/2007 | Vijayendran et al. | |
| 2008/0107989 | A1 | 5/2008 | Sacripante et al. | |
| 2008/0107990 | A1 | 5/2008 | Field et al. | |
| 2008/0145775 | A1 * | 6/2008 | Vijayendran et al. | 430/109.3 |
| 2008/0153027 | A1 | 6/2008 | Veregin et al. | |
| 2008/0236446 | A1 | 10/2008 | Zhou et al. | |
| 2009/0047593 | A1 | 2/2009 | Vanbesien et al. | |
| 2009/0155703 | A1 | 6/2009 | Sacripante et al. | |
| 2010/0099037 | A1 * | 4/2010 | McAneney et al. | 430/108.21 |
| 2010/0203439 | A1 * | 8/2010 | Zhou | G03G 9/0804 430/108.6 |
| 2010/0239969 | A1 * | 9/2010 | Owada et al. | 430/108.2 |
| 2010/0248122 | A1 * | 9/2010 | Sacripante | G03G 9/08755 430/109.4 |
| 2012/0156607 | A1 * | 6/2012 | Farrugia et al. | 430/108.4 |

* cited by examiner

*Primary Examiner* — Thorl Chea
(74) *Attorney, Agent, or Firm* — Marylou J. Lavoie, Esq. LLC

(57) ABSTRACT

Environmentally friendly toner particles are provided which may include a bio-based amorphous polyester resin including camphoric acid, optionally in combination with a crystalline resin. Methods for providing these toners are also provided.

18 Claims, 2 Drawing Sheets

TONER COMPOSITIONS AND PROCESSES

TECHNICAL FIELD

The present disclosure relates to resins suitable for use in toner compositions. More specifically, the present disclosure relates to bio-based polyester resins suitable for use in toner compositions and processes for producing same.

BACKGROUND

Numerous processes are within the purview of those skilled in the art for the preparation of toners. Emulsion aggregation (EA) is one such method. Emulsion aggregation/coalescing processes for the preparation of toners are illustrated in a number of patents, such as U.S. Pat. Nos. 5,290,654, 5,278,020, 5,308,734, 5,344,738, 6,593,049, 6,743,559, 6,756,176, 6,830,860, 7,029,817, and 7,329,476, and U.S. Patent Application Publication Nos. 2006/0216626, 2008/0107989, 2008/0107990, 2008/0236446, and 2009/0047593. The disclosures of each of the foregoing patents are hereby incorporated by reference in their entirety.

Polyester EA ultra low melt (ULM) toners have been prepared utilizing amorphous and crystalline polyester resins as illustrated, for example, in U.S. Patent Application Publication No. 2008/0153027, the disclosure of which is hereby incorporated by reference in its entirety.

Many polymeric materials utilized in the formation of toners are based upon the extraction and processing of fossil fuels, leading ultimately to increases in greenhouse gases and accumulation of non-degradable materials in the environment. Furthermore, current polyester based toners may be derived from a bisphenol A monomer, which is a known carcinogen/endocrine disruptor.

Bio-based polyester resins have been utilized to reduce the need for this problematic monomer. An example, as disclosed in co-pending U.S. Patent Application Publication No. 2009/0155703, includes a toner having particles of a bio-based resin, such as, for example, a semi-crystalline biodegradable polyester resin including polyhydroxyalkanoates, wherein the toner is prepared by an emulsion aggregation process.

Alternative, cost-effective, environmentally friendly toners remain desirable.

SUMMARY

The present disclosure provides environmentally friendly toners and processes for producing these toners. In embodiments, a toner of the present disclosure includes at least one bio-based amorphous polyester resin including camphoric acid in an amount from about 1% by weight to about 60% by weight of the bio-based resin; optionally, at least one crystalline polyester resin; and optionally, one or more ingredients such as colorants, waxes, coagulants, and combinations thereof.

In other embodiments, a toner of the present disclosure includes at least one bio-based amorphous polyester resin including camphoric acid in combination with at least one other component such as D-isosorbide, naphthalene dicarboxylate, azelaic acid, cyclohexane-1,4-dicarboxylic acid, succinic acid, dodecenyl succinic anhydride, dimethyl terephthalate, dimer acid, propylene glycol, ethylene glycol, and combinations thereof; optionally, at least one crystalline polyester resin; and optionally, one or more ingredients such as colorants, waxes, coagulants, and combinations thereof, wherein the bio-based amorphous polyester resin includes bio-based monomers in an amount of from about 45% by weight of the resin to about 100% by weight of the resin.

In yet other embodiments, a toner of the present disclosure includes at least one bio-based amorphous polyester resin including camphoric acid in an amount from about 1% by weight to about 60% by weight of the bio-based resin, in combination with at least one other component such as D-isosorbide, naphthalene dicarboxylate, azelaic acid, cyclohexane-1,4-dicarboxylic acid, succinic acid, dodecenyl succinic anhydride, dimethyl terephthalate, dimer acid, propylene glycol, ethylene glycol, and combinations thereof; at least one crystalline polyester resin; and one or more ingredients such as colorants, waxes, coagulants, and combinations thereof, wherein the bio-based amorphous polyester resin includes bio-based monomers in an amount of from about 45% by weight of the resin to about 100% by weight of the resin.

BRIEF DESCRIPTION OF DRAWINGS

Various embodiments of the present disclosure will be described herein below with reference to the figures wherein.

DETAILED DESCRIPTION

Figure 1:
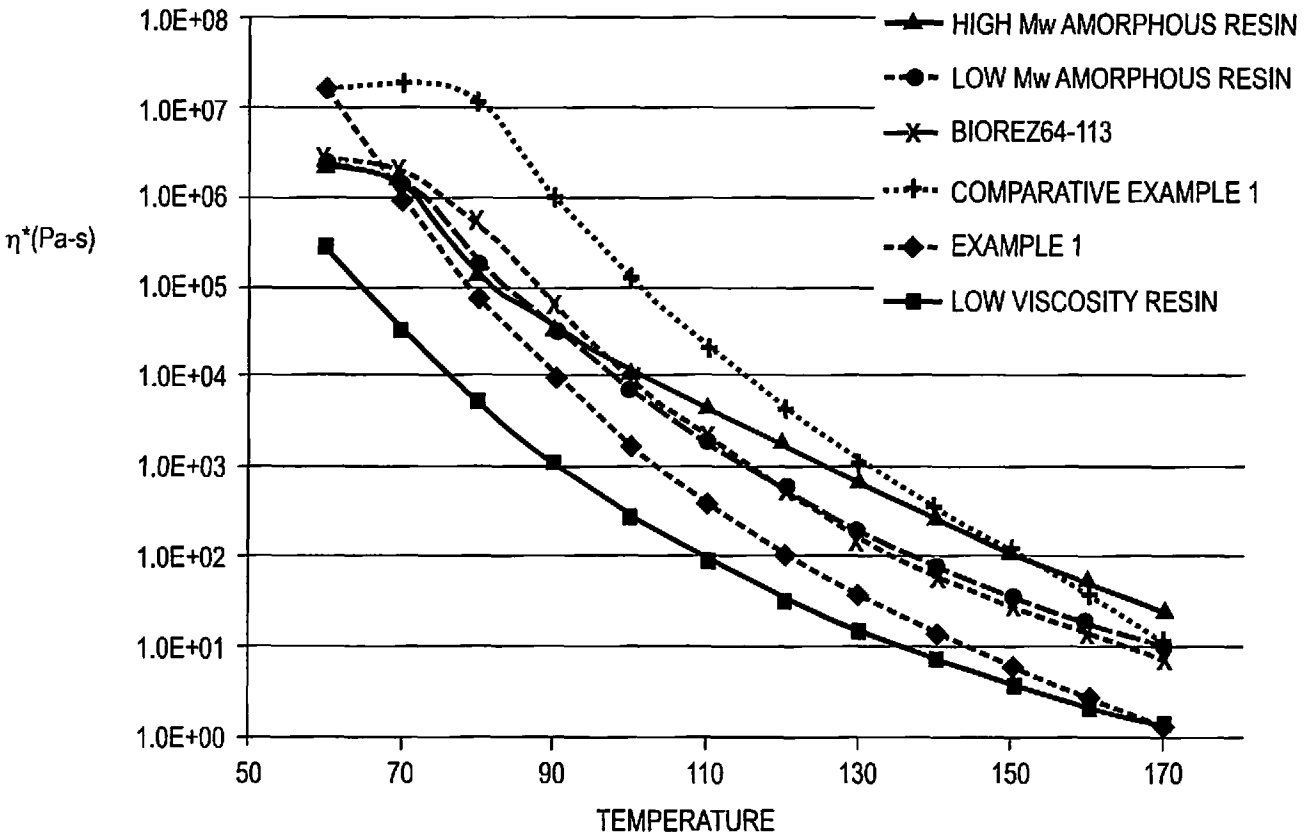
FIG. 1 is a graph depicting the rheological temperature profile of a resin of the present disclosure compared with other resins.

The present disclosure provides toner processes for the preparation of toner compositions, as well as toners produced by these processes. In embodiments, toners may be produced by a chemical process, such as emulsion aggregation, wherein a bio-based latex resin is aggregated, optionally with amorphous resins, crystalline resins, a wax and a colorant, in the presence of a coagulant, and thereafter stabilizing the aggregates and coalescing or fusing the aggregates such as by heating the mixture above the glass transition temperature (Tg) of the resin to provide toner size particles.

Bio-based resins or products, as used herein, in embodiments, include commercial and/or industrial products (other than food or feed) that may be composed, in whole or in significant part, of biological products or renewable domestic agricultural materials (including plant, animal, or marine materials) and/or forestry materials as defined by the U.S. Office of the Federal Environmental Executive.

In embodiments, a bio-based polyester resin may be utilized as a latex resin. In embodiments, the resin may include camphoric acid.

Bio-Based Resins

Resins utilized in accordance with the present disclosure include bio-based amorphous resins. As used herein, a bio-based resin is a resin or resin formulation derived from a biological source such as plant-based feed stocks, in embodiments vegetable oils, instead of petrochemicals. As renewable polymers with low environmental impact, their advantages include that they reduce reliance on finite resources of petrochemicals, and they sequester carbon from the atmosphere. A bio-resin includes, in embodiments, for example, a resin wherein at least a portion of the resin is derived from a natural biological material, such as animal, plant, combinations thereof, and the like.

In embodiments, bio-based resins may include natural triglyceride vegetable oils (e.g. rapeseed oil, soybean oil, sunflower oil), or phenolic plant oils such as cashew nut shell liquid (CNSL), combinations thereof, and the like. Suitable bio-based amorphous resins include polyesters, polyamides, polyimides, and polyisobutyrates, combinations thereof, and the like.

Examples of amorphous bio-based polymeric resins which may be utilized include polyesters derived from monomers including a fatty dimer acid or diol of soya oil, D-isosorbide, and/or amino acids such as L-tyrosine and glutamic acid as described in U.S. Pat. Nos. 5,959,066, 6,025,061, 6,063,464, and U.S. Patent Application Publication Nos. 2008/0145775 and 2007/0015075, the disclosures of each of which are hereby incorporated by reference in their entirety.

Monomers utilized to form the bio-based resin include, in embodiments, D-isosorbide, naphthalene dicarboxylic acid, additional dicarboxylic acids such as, for example, azelaic acid, cyclohexane-1,4-dicarboxylic acid, succinic acid, citric acid, and combinations thereof, anhydrides such as dodecenyl succinic anhydride, succinic anhydride, trimellitic anhydride, and combinations thereof, and phthalates and/or terephthalates including dimethyl terephthalate, terephthalic acid, and combinations thereof. Other monomers utilized to form the bio-based resin include, for example, a dimer acid such as EMPOL 1061®, EMPOL 1062®, EMPOL 1012® and EMPOL 1016®, from Cognis Corp., or PRIPOL 1009®, PRIPOL 1012®, PRIPOL 1013® from Croda Ltd., a dimer diol such as SOVERMOL 908 from Cognis Corp. or PRIPOL 2033 from Croda Ltd., and combinations thereof. Glycols, including propylene glycol and/or ethylene glycol, may also be used to form a bio-based resin. Combinations of the foregoing components may be utilized, in embodiments.

In embodiments, suitable bio-based polymeric resins may include polyesters including camphoric acid. Camphor is produced synthetically from alpha-pinene, a natural product derived from turpentine (and thus is a by-product of the rosins produced as waste products in the forestry and paper-making industries). Camphoric acid can be prepared from the semi-synthetic camphor produced in this process, or from the penultimate intermediate material (isoborneol). Every carbon atom of camphoric acid is thus ultimately derived from tree rosin. Camphoric acid is one of the few commercially available diacids that is both derived from renewable resources and contains a ring structure. Camphoric acid's rigid ring structure makes it suitable for use as a terephthalic acid, cyclohexane dicarboxylic acid or naphthalene dicarboxylic acid substitute in amorphous resins. Replacing these petroleum-derived monomers with camphoric acid increases the bio-based, and thus renewable, content of the resulting resins.

In accordance with the present disclosure, the use of camphoric acid may not only provide an environmentally friendly alternative to monomers utilized in toner production, but may also, when used to prepare polyesters for toner, provide resins with high enough glass transition temperatures and low equilibrium moisture content, which are desirable for electrophotographic charging and fusing properties of the resulting toners.

In embodiments, at least 45% of the monomer starting materials used to prepare the bio-based polyester resin may be derived from bio-based sources. In embodiments, a bio-based polyester resin of the present disclosure may thus contain bio-based monomers in an amount of from about 45% by weight of the resin to about 100% by weight of the resin, in embodiments from about 50% by weight of the resin to about 70% by weight of the resin.

For example, a bio-based resin of the present disclosure may include, in embodiments, D-isosorbide in amounts from about 2% by weight to about 60% by weight of the bio-based resin, in embodiments from about 5% by weight to about 40% by weight of the bio-based resin, dimethyl naphthalene 2,6-dicarboxylate in amounts from about 2% by weight to about 50% by weight of the bio-based resin, in embodiments from about 5% by weight to about 40% by weight of the bio-based resin, camphoric acid in amounts from about 1% by weight to about 60% by weight of the bio-based resin, in embodiments from about 10% by weight to about 50% by weight of the bio-based resin, a dimer acid in amounts from about 0.02% by weight to about 50% by weight of the bio-based resin, in embodiments from about 0.04% by weight to about 20% by weight of the bio-based resin, and a glycol such as propylene glycol in amounts from about 5% by weight to about 50% by weight of the bio-based resin, in embodiments from about 10% by weight to about 40% by weight of the bio-based resin.

In other embodiments, a bio-based resin of the present disclosure may include dodecenyl succinic anhydride in amounts from about 2% by weight to about 40% by weight of the bio-based resin, in embodiments from about 5% by weight to about 30% by weight of the bio-based resin, camphoric acid in amounts from about 1% by weight to about 60% by weight of the bio-based resin, in embodiments from about 10% by weight to about 50% by weight of the bio-based resin, dimethyl terephthalate in amounts from about 2% by weight to about 50% by weight of the bio-based resin, in embodiments from about 5% by weight to about 40% by weight of the bio-based resin, and a glycol such as propylene glycol in amounts from about 5% by weight to about 50% by weight of the bio-based resin, in embodiments from about 10% by weight to about 40% by weight of the bio-based resin.

In embodiments, a suitable amorphous bio-based resin may have a glass transition temperature of from about 25° C. to about 90° C., in embodiments from about 30° C. to about 70° C., a softening point (sometimes referred to herein as Ts) of from about 90° C. to about 140° C., in embodiments from about 100° C. to about 130° C., a weight average molecular weight (Mw) as measured by gel permeation chromatography (GPC) of from about 1,500 grams/mol (g/mol) to about 100,000 g/mol, in embodiments of from about 3,000 g/mol to about 20,000 g/mol, a number average molecular weight (Mn) as measured by gel permeation chromatography (GPC) of from about 1,000 g/mol to about 50,000 g/mol, in embodiments from about 2,000 g/mol to about 15,000 g/mol, a molecular weight distribution (Mw/Mn), sometimes referred to herein as polydispersity (PDI) of from about 1 to about 20, in embodiments from about 2 to about 15, and a carbon/oxygen ratio of from about 2 to about 6, in embodiments of from about 3 to about 5. In embodiments, the combined resins utilized in the latex may have a melt viscosity from about 10 to about 100,000 Pa*S at about 130° C., in embodiments from about 50 to about 10,000 Pa*S.

The amorphous bio-based resin may be present, for example, in amounts of from about 10 to about 90 percent by weight of the toner components, in embodiments from about 20 to about 80 percent by weight of the toner components.

In embodiments, the amorphous bio-based polyester resin may form emulsions with particle sizes of from about 40 nm to about 800 nm in diameter, in embodiments from about 75 nm to 225 nm in diameter.

In embodiments the amorphous bio-based polyester resin may possess hydroxyl groups at the terminal ends of the resin. It may be desirable, in embodiments, to convert these hydroxyl groups to acid groups, including carboxylic acid groups, and the like.

In embodiments, the hydroxyl groups at the terminal ends of the amorphous bio-based polyester resin may be converted to carboxylic acid groups by reacting the amorphous bio-based polyester resin with a multi-functional bio-based acid or a cyclic anhydride. Such acids include, for example, citric acid, citric acid anhydride, succinic anhydride, combinations thereof, and the like. The amount of acid to be reacted with the amorphous bio-based polyester resin will depend on the amorphous bio-based polyester resin, the desired amount of conversion of hydroxyl groups to carboxylic acid groups, and the like.

In embodiments, the amount of multi-functional bio-based acid added to the amorphous bio-based polyester resin may be from about 0.1% by weight to about 20% by weight of the resin solids, in embodiments from about 0.5% by weight to about 10% by weight of the resin solids, in embodiments from about 1% by weight to about 7.5% by weight of the resin solids.

In embodiments, the resulting bio-based amorphous resin, in embodiments including camphoric acid, may have an acid value, sometimes referred to herein, in embodiments, as an acid number, of less than about 30 mg KOH/g of resin, in embodiments from about 5 mg KOH/g of resin to about 30 mg KOH/g of resin, in embodiments from about 7 mg KOH/g of resin to about 25 mg KOH/g of resin. The acid containing resin may be dissolved in tetrahydrofuran solution. The acid value may be detected by titration with a KOH/methanol solution containing phenolphthalein as the indicator. The acid value (or neutralization number) is the mass of potassium hydroxide (KOH) in milligrams that is required to neutralize one gram of the resin.

The bio-based resin of the present disclosure, in embodiments including camphoric acid, may have a carbon to oxygen ratio (sometimes referred to herein, in embodiments, as a C/O ratio), of from about 1.5 to about 7, in embodiments from about 2 to about 6, in embodiments from about 2.5 to about 5, in embodiments from about 3.5 to about 4.7. (The carbon/oxygen ratio may be determined using a theoretical calculation derived by taking the ratio weight % of carbon to weight % of oxygen.)

In embodiments, the components (e.g., diols) utilized to make the resin may be non-petroleum based, so that the resulting polyester is derived from renewable resources, i.e., bio-based. Products can be tested for whether they are sourced from petroleum or from renewable resources by radiocarbon ($^{14}C$) dating. The current known natural abundance ratio of $^{14}C/^{12}C$ for bio-based carbon is about $1\times10^{-12}$. In contrast, fossil carbon includes no radiocarbons, as its age is much grater than the half-life of $^{14}C$ (about 5730 years). Put another way, the $^{14}C$ that would exist at the time the fossil resource was created would have changed to $^{12}C$ through a radioactive disintegration process. Thus the ratio of $^{14}C/^{12}C$ would be zero in a fossil based material. To the contrary, in embodiments, a bio-based resin produced in accordance with the present disclosure may have a $^{14}C/^{12}C$ molar ratio of from about $0.5\times10^{-12}$ to about $1\times10^{-12}$, in embodiments from about $0.6\times10^{-12}$ to about $0.95\times10^{-12}$ $^{14}C/^{12}C$ molar ratio, in embodiments from about $0.7\times10^{-12}$ to about $0.9\times10^{-12}$ $^{14}C/^{12}C$ molar ratio.

In embodiments, the resin may be formed by condensation polymerization methods. In other embodiments, the resin may be formed by emulsion polymerization methods.

Other Resins

The above bio-based resins may be used alone or may be used with any other resin suitable in forming a toner.

In embodiments, the resins may be an amorphous resin, a crystalline resin, and/or a combination thereof. In further embodiments, the polymer utilized to form the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis, 1,4-diacetoxy-2-butene, diethyl fumarate, diethyl maleate, maleic acid, succinic acid, itaconic acid, succinic acid, cyclohexanoic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl naphthalenedicarboxylate, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diols selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, the resin may be a crosslinkable resin. A crosslinkable resin is a resin including a crosslinkable group or groups such as a C═C bond. The resin can be crosslinked, for example, through a free radical polymerization with an initiator.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable amorphous resin may include alkoxylated bisphenol A fumarate/terephthalate based polyester and copolyester resins. In embodiments, a suitable polyester resin may be an amorphous polyester such as a poly(propoxylated bisphenol A co-fumarate) resin having the following formula (I):

(I)

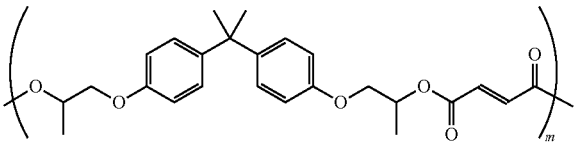

wherein m may be from about 5 to about 1000, although the value of m can be outside of this range. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrials Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like, including their structural isomers. The aliphatic diol may be, for example, selected in an amount from about 40 to about 60 mole percent, in embodiments from about 42 to about 55 mole percent, in embodiments from about 45 to about 53 mole percent, and a second diol can be selected in an amount from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid (sometimes referred to herein, in embodiments, as cyclohexanedioic acid), malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent, and a second diacid can be selected in an amount from about 0 to about 10 mole percent of the resin.

Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), polyethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfa-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipatenonylene-decanoate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), polyethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and polybutylene-succinimide).

The crystalline resin may be present, for example, in an amount from about 1 to about 85 percent by weight of the toner components, in embodiments from about 2 to about 50 percent by weight of the toner components, in embodiments from about 5 to about 15 percent by weight of the toner components. The crystalline resin can possess various melting points of, for example, from about 30° C. to about 120° C., in embodiments from about 50° C. to about 90° C., in embodiments from about 60° C. to about 80° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Suitable crystalline resins which may be utilized, optionally in combination with an amorphous resin as described above, include those disclosed in U.S. Patent Application Publication No. 2006/0222991, the disclosure of which is hereby incorporated by reference in its entirety.

In embodiments, a suitable crystalline resin may include a resin formed of ethylene glycol and a mixture of dodecanedioic acid and fumaric acid co-monomers with the following formula:

(II)

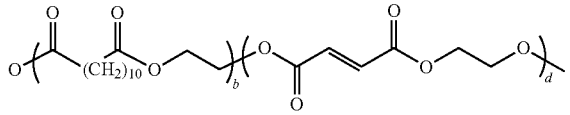

wherein b is from about 5 to about 2000 and d is from about 5 to about 2000.

Toner

The resins described above may be utilized to form toner compositions. One, two, or more resins may be used. In embodiments, where two or more resins are used, the resins may be in any suitable ratio (e.g., weight ratio) such as for instance of from about 1% (first resin)/99% (second resin) to about 99% (first resin)/1% (second resin), in embodiments from about 4% (first resin)/96% (second resin) to about 96% (first resin)/4% (second resin). Where the resin includes a crystalline resin and a bio-based amorphous resin, the weight ratio of the resins may be from 1% (crystalline resin):99% (bio-based amorphous resin), to about 10% (crystalline resin):90% (bio-based amorphous resin).

Toner compositions may also include optional colorants, waxes, coagulants and other additives, such as surfactants. Toners may be formed utilizing any method within the purview of those skilled in the art. The toner particles may also include other conventional optional additives, such as colloidal silica (as a flow agent).

The resulting latex formed from the resins described above may be utilized to form a toner by any method within the purview of those skilled in the art. The latex emulsion may be contacted with a colorant, optionally in a dispersion, and other additives to form an ultra low melt toner by a suitable process, in embodiments, an emulsion aggregation and coalescence process.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the use of anionic and nonionic surfactants help stabilize the aggregation process in the presence of the coagulant, which otherwise could lead to aggregation instability.

In embodiments, the surfactant may be added as a solid or as a solution with a concentration from about 5% to about 100% (pure surfactant) by weight, in embodiments, from about 10% to about 95 weight percent. In embodiments, the surfactant may be utilized so that it is present in an amount from about 0.01 weight percent to about 20 weight percent of the resin, in embodiments, from about 0.1 weight percent to about 16 weight percent of the resin, in other embodiments, from about 1 weight percent to about 14 weight percent of the resin.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecylbenzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Examples of nonionic surfactants that can be utilized include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, ANTAROX 890™ and ANTAROX 897™ (alkyl phenol ethoxylate). Other examples of suitable nonionic surfactants include a block copolymer of polyethylene oxide and polypropylene oxide, including those commercially available as SYNPERONIC PE/F, in embodiments SYNPERONIC PE/F 108.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner, although the amount of colorant can be outside of these ranges.

As examples of suitable colorants, mention may be made of carbon black like REGAL 330° (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), HOSTAPERM PINK E™ (Hoechst), Fanal Pink D4830 (BASF), CINQUASIA MAGENTA™ (DuPont), Paliogen Black L9984 (BASF), Pigment Black K801 (BASF), Levanyl Black A-SF (Miles, Bayer), combinations of the foregoing, and the like.

Other suitable water based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365× and 9504X (Pigment Red 57 15850:1, Sunsperse YHD 6005X (Pigment Yellow 83 21108), Flexiverse YFD 4249 (Pigment Yellow 17 21105), Sunsperse YHD 6020× and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC$^{1026}$™, E.D. TOLUIDINE RED™ and BON RED C™ available from Dominion Color Corporation, Ltd., Toronto, Ontario, NOVAPERM YELLOW FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

In embodiments, the colorant may include a pigment, a dye, combinations thereof, carbon black, magnetite, black, cyan, magenta, yellow, red, green, blue, brown, combinations thereof, in an amount sufficient to impart the desired color to the toner. It is to be understood that other useful colorants will become readily apparent based on the present disclosures.

In embodiments, a pigment or colorant may be employed in an amount of from about 1 weight percent to about 35 weight percent of the toner particles on a solids basis, in other embodiments, from about 5 weight percent to about 25 weight percent of the toner particles on a solids basis.

Wax

Optionally, a wax may also be combined with the resin and a colorant in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1 weight percent to about 25 weight percent of the toner particles, in embodiments from about 5 weight percent to about 20 weight percent of the toner particles.

When a wax dispersion is used, the wax dispersion may include any of the various waxes conventionally used in emulsion aggregation toner compositions. Waxes that may be selected include waxes having, for example, a weight average molecular weight from about 500 to about 20,000, in embodiments from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethylene glycol monostearate, dipropylene glycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be from about 100 nm to about 300 nm.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in, for example, U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion aggregation processes, such as a process that includes aggregating a mixture of an optional colorant, an optional wax, an optional coagulant, and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin(s). For example, emulsion/aggregation/coalescing processes for the preparation of toners are illustrated in the disclosure of the patents and publications referenced hereinabove.

The pH of the resulting mixture of resins, colorants, waxes, coagulants, additives, and the like, may be adjusted by an acid such as, for example, acetic acid, sulfuric acid, hydrochloric acid, citric acid, trifluoro acetic acid, succinic acid, salicylic acid, nitric acid or the like. In embodiments, the pH of the mixture may be adjusted to from about 2 to about 5. In embodiments, the pH is adjusted utilizing an acid in a diluted form of from about 0.5 to about 10 weight percent by weight of water, in other embodiments, of from about 0.7 to about 5 weight percent by weight of water.

Additionally, in embodiments, the mixture may be homogenized. If the mixture is homogenized, homogenization may be accomplished by mixing at a speed of from about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, combinations thereof, and the like.

Other suitable aggregating agents also include, but are not limited to, tetraalkyl titinates, dialkyltin oxide, tetraalkyltin oxide hydroxide, dialkyltin oxide hydroxide, aluminum alkoxides, alkyl zinc, dialkyl zinc, zinc oxides, stannous oxide, dibutyltin oxide, dibutyltin oxide hydroxide, tetraalkyl tin, combinations thereof, and the like.

Where the aggregating agent is a polyion aggregating agent, the agent may have any desired number of polyion atoms present. For example, in embodiments, suitable polyaluminum compounds have from about 2 to about 13, in other embodiments, from about 3 to about 8, aluminum ions present in the compound.

The aggregating agent may be added to the mixture utilized to form a toner in an amount of, for example, from about 0.1 to about 10 weight percent, in embodiments from about 0.2 to about 8 weight percent, in other embodiments from about 0.5 to about 5 weight percent, of the resin in the mixture. This should provide a sufficient amount of agent for aggregation.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example from about 40° C. to about 90° C., in embodiments from about 45° C. to about 80° C., which may be below the glass transition temperature of the resin(s) utilized to form the toner particles.

As noted above, the acidified bio-based resin of the present disclosure may, in embodiments, have additional free carboxylic acids thereon, which are capable of reacting with coagulants and other cationic species such as $Al_2(SO_4)_3$.

Once the desired final size of the toner particles is achieved, the pH of the mixture may be adjusted with a base to a value from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a resin coating may be applied to the aggregated particles to form a shell thereover. Any resin described above may be utilized as the shell. In embodiments, a polyester amorphous resin latex as described above may be included in the shell. In embodiments, the polyester amorphous resin latex described above may be combined with a different resin, and then added to the particles as a resin coating to form a shell.

In embodiments, resins which may be utilized to form a shell include, but are not limited to, the amorphous resins described above in combination with the acidified bio-based amorphous resin as described above. In yet other embodiments, the bio-based resin described above may be combined with another resin and then added to the particles as a resin coating to form a shell.

The shell resin may be applied to the aggregated particles by any method within the purview of those skilled in the art. In embodiments, the resins utilized to form the shell may be in an emulsion including any surfactant described above. The emulsion possessing the resins may be combined with the aggregated particles described above so that the shell forms over the aggregated particles. In embodiments, the shell may have a thickness of up to about 5 microns, in embodiments, of from about 0.1 to about 2 microns, in other embodiments, from about 0.3 to about 0.8 microns, over the formed aggregates.

The formation of the shell over the aggregated particles may occur while heating to a temperature from about 30° C. to about 80° C., in embodiments from about 35° C. to about 70° C. The formation of the shell may take place for a period of time from about 5 minutes to about 10 hours, in embodiments from about 10 minutes to about 5 hours.

The shell may be present in an amount from about 1 percent by weight to about 80 percent by weight of the toner particles, in embodiments from about 10 percent by weight to about 40 percent by weight of the toner particles, in other embodiments from about 20 percent by weight to about 35 percent by weight of the toner particles.

Coalescence

Following aggregation to the desired particle size and application of any optional shell, the particles may then be coalesced to the desired final shape, the coalescence being achieved by, for example, heating the mixture to a temperature from about 45° C. to about 100° C., in embodiments from about 55° C. to about 99° C., which may be at or above the glass transition temperature of the resins utilized to form the toner particles, and/or reducing the stirring, for example to from about 100 rpm to about 1,000 rpm, in embodiments from about 200 rpm to about 800 rpm. The fused particles can be measured for shape factor or circularity, such as with a Sysmex FPIA 2100 analyzer, until the desired shape is achieved.

Coalescence may be accomplished over a period from about 0.01 to about 9 hours, in embodiments from about 0.1 to about 4 hours.

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount from about 0.1 to about 10 weight percent of the toner, in embodiments from about 1 to about 3 weight percent of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like. Such charge control agents may be applied simultaneously with the shell resin described above or after application of the shell resin.

There can also be blended with the toner particles external additive particles after formation including flow aid additives, which additives may be present on the surface of the toner particles. Examples of these additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and mixtures thereof.

In general, silica may be applied to the toner surface for toner flow, triboelectric charge enhancement, admix control, improved development and transfer stability, and higher toner blocking temperature. $TiO_2$ may be applied for improved relative humidity (RH) stability, triboelectric charge control and improved development and transfer stability. Zinc stearate, calcium stearate and/or magnesium stearate may optionally also be used as an external additive for providing lubricating properties, developer conductivity, triboelectric charge enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount from about 0.1 weight percent to about 5 weight percent of the toner, in embodiments from about 0.25 weight percent to about 3 weight percent of the toner, although the amount of additives can be outside of these ranges. In embodiments, the toners may include, for example, from about 0.1 weight percent to about 5 weight percent titania, from about 0.1 weight percent to about 8 weight percent silica, and from about 0.1 weight percent to about 4 weight percent zinc stearate.

Suitable additives include those disclosed in U.S. Pat. Nos. 3,590,000, and 6,214,507, the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a core and/or shell may, exclusive of external surface additives, have one or more the following characteristics:

(1) Volume average diameter (also referred to as "volume average particle diameter") of from about 3 to about 25 μm, in embodiments from about 4 to about 15 μm, in other embodiments from about 5 to about 12 μm.

(2) Number Average Geometric Size Distribution (GSDn) and/or Volume Average Geometric Size Distribution (GSDv): In embodiments, the toner particles described in (1) above may have a narrow particle size distribution with a lower number ratio GSD of from about 1.15 to about 1.38, in other embodiments, less than about 1.31. The toner particles of the present disclosure may also have a size such that the upper GSD by volume in the range of from about 1.2 to about 1.4, in other embodiments, from about 1.26 to about 1.3. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

(3) Shape factor of from about 105 to about 170, in embodiments, from about 110 to about 160, SF1*a. Scanning electron microscopy (SEM) may be used to determine the shape factor analysis of the toners by SEM and image analysis (IA). The average particle shapes are quantified by employing the following shape factor (SF1*a) formula:

$$SF1*a=100\pi d^2/(4A), \quad \text{(IV)}$$

where A is the area of the particle and d is its major axis. A perfectly circular or spherical particle has a shape factor of exactly 100. The shape factor SF1*a increases as the shape becomes more irregular or elongated in shape with a higher surface area.

(4) Circularity of from about 0.92 to about 0.99, in other embodiments, from about 0.94 to about 0.975. The instrument used to measure particle circularity may be an FPIA-2100 manufactured by SYSMEX, following the manufacturer's instructions.

The characteristics of the toner particles may be determined by any suitable technique and apparatus and are not limited to the instruments and techniques indicated hereinabove.

In embodiments, the toner particles may have a weight average molecular weight (Mw) of from about 1,500 g/mol to about 60,000 g/mol, in embodiments from about 2,500 g/mol to about 18,000 g/mol, a number average molecular weight (Mn) of from about 1,000 g/mol to about 18,000 g/mol, in embodiments from about 1,500 g/mol to about 10,000 g/mol, and a MWD (a ratio of the Mw to Mn of the toner particles, which is a measure of the polydispersity of the polymer) of from about 1.7 to about 10, in embodiments from about 2 to about 6. For colored toners, including cyan, yellow, black and magenta toners, the toner particles can exhibit a weight average molecular weight (Mw) of from about 1,500 g/mol to about 45,000 g/mol, in embodiments from about 2,500 g/mol to about 15,000 g/mol, a number average molecular weight (Mn) of from about 1,000 g/mol to about 15,000 g/mol, in embodiments from about 1,500 g/mol to about 10,000 g/mol, and a MWD of from about 1.7 to about 10, in embodiments from about 2 to about 6.

Toners produced in accordance with the present disclosure may possess excellent charging characteristics when exposed to extreme relative humidity (RH) conditions. The low-humidity zone (C zone) may be about 12° C./15% RH, while the high humidity zone (A zone) may be about 28° C./85% RH. Toners of the present disclosure may possess a parent toner charge per mass ratio (Q/M) of from about −2 μC/g to about −50 μC/g, in embodiments from about −4 μC/g to about −35 μC/g, and a final toner charging after surface additive blending of from −8 μC/g to about −40 μC/g, in embodiments from about −10 μC/g to about −25 μC/g.

Developer

The toner particles may be formulated into a developer composition. For example, the toner particles may be mixed with carrier particles to achieve a two-component developer composition. The carrier particles can be mixed with the toner particles in various suitable combinations. The toner concentration in the developer may be from about 1% to about 25% by weight of the developer, in embodiments from about 2% to about 15% by weight of the total weight of the developer (although values outside of these ranges may be used). In embodiments, the toner concentration may be from about 90% to about 98% by weight of the carrier (although values outside of these ranges may be used). However, different toner and carrier percentages may be used to achieve a developer composition with desired characteristics.

Carriers

Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include granular zircon, granular silicon, glass, silicon dioxide, iron, iron alloys, steel, nickel, iron ferrites, including ferrites that incorporate strontium, magnesium, manganese, copper, zinc, and the like, magnetites, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include polyolefins, fluoropolymers, such as polyvinylidene fluoride resins, terpolymers of styrene, acrylic and methacrylic polymers such as methyl methacrylate, acrylic and methacrylic copolymers with fluoropolymers or with monoalkyl or dialkylamines, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 weight % to about 70 weight %, in embodiments from about 40 weight % to about 60 weight % (although values outside of these ranges may be used). The coating may have a coating weight of, for example, from about 0.1 weight % to about 5% by weight of the carrier, in embodiments from about 0.5 weight % to about 2% by weight of the carrier (although values outside of these ranges may be obtained).

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 weight % to about 10 weight %, in embodiments from about 0.01 weight % to about 3 weight %, based on the weight of the coated carrier particles (although values outside of these ranges may be used), until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size (although sizes outside of these ranges may be used), coated with about 0.5% to about 10% by weight, in embodiments from about 0.7% to about 5% by weight (although amounts outside of these ranges may be obtained), of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition (although concentrations outside of this range may be obtained). However, different toner and carrier percentages may be used to achieve a developer composition with desired characteristics.

Imaging

Toners of the present disclosure may be utilized in electrophotographic imaging methods. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature from about 20° C. to about 25° C.

EXAMPLES

Comparative Example 1

A control bio-based resin, that was about 57% bio-based, was made using propylene glycol. A 1 liter Parr Bench Top Reactor was fitted with a short path condenser, a nitrogen inlet, and a magnetic stir shaft connected to a controller. The vessel was charged with about 215 grams (about 1471.19 mmol) of isosorbide (IS), about 172.18 grams (about 704.96 mmol) of dimethyl naphthalene-2,6-dicarboxylate (NDC), about 64.37 grams (about 845.95 mmol) of propylene glycol (PG), and about 0.584 grams (about 2.795 mmol) of a butylstannoic acid catalyst (FASCAT® 4100, commercially available from Arkema). The vessel and its contents were purged with nitrogen and the reactor was heated so that the contents of the vessel reached about 150° C. over a period of about 50 minutes. The stirrer was turned on once the vessel reached 150° C. and the temperature was increased to about 215° C. over a period of about 2 hours. By the time the temperature of the vessel reached 215° C., polycondensation of the reactant diols and diester had begun. Approximately 31 grams of a distillate was collected. The vessel was left to heat overnight at about 190° C.

The next day, about 57.29 grams (about 101.41 mmol) of a dimer diacid, commercially available as PRIPOL® 1012 from Croda, and about 74.7 grams (about 433.82 mmol) of 1,4-cyclohexane dicarboxylic acid (1,4-CHDA) were charged into the vessel. The temperature was increased to about 205° C. and the total distillate collected was about 63 grams after about 4 hours of heating. The vacuum receiver was then attached to the vacuum pump via a hose and the pressure in the reaction vessel was lowered from atmospheric to about 0.09 Torr over a period of about 9 hours, while collecting additional distillate (a total of about 101.3 grams).

The reaction continued over about 9 hours under vacuum to increase molecular weight, as checked by the softening point value measured with a dropping point cell (Mettler FP90 central processor with a Mettler FP83HT Dropping Point Cell). Once the appropriate softening point was reached, the reaction was terminated by achieving atmospheric pressure. The temperature was decreased to about 190° C. and about 8.76 grams of trimellitic anhydride (TMA) was added to the vessel. TMA was added to increase the acid functionality at the polymer chain ends. After reacting for about 1 hour at about 190° C., the polymer was discharged into an aluminum pan. After the polymer resin cooled to room temperature, the polymer was broken into small chunks with a chisel and a small portion was ground in a M20 IKA Werke mill.

The ground polymer was analyzed for molecular weight by gel permeation chromatography (GPC), glass transition temperature (Tg) by differential scanning calorimetry (DSC), and viscosity using an AR2000 rheometer. The acid value (or "neutralization number" or "acid number" or "acidity") was measured by dissolving a known amount of polymer sample in organic solvent and titrating with a solution of potassium hydroxide with known concentration and with phenolphthalein as a color indicator. Acid number was the mass of potassium hydroxide (KOH) in milligrams that was required to neutralize one gram of chemical substance. In this case, the acid number was the measure of the amount of carboxylic acid groups in polyester molecule.

Table 1 below summarizes the reactants utilized to form the resin of Comparative Example 1.

TABLE 1

| | Reactant | MW | Equivalents (Eq.) | Moles (mmol) | Reactant Mass (g) |
|---|---|---|---|---|---|
| 1 | Isosorbide | 146.1 | 0.5426 | 1472 | 215.0 |
| 2 | Dimethyl Napthalene-2,6-dicarboxylate | 244.2 | 0.2600 | 705 | 172.2 |
| 3 | FASCAT ® 4100 catalyst | 208.8 | 0.001053 | 2.86 | 0.596 |

TABLE 1-continued

| | Reactant | MW | Equivalents (Eq.) | Moles (mmol) | Reactant Mass (g) |
|---|---|---|---|---|---|
| 4 | Cyclohexane-1,4-dicarboxylic acid | 172.2 | 0.1600 | 434 | 74.7 |
| 5 | Dimer Acid (PRIPOL ® 1012) | 565 | 0.0374 | 101 | 57.3 |
| 6 | Propylene Glycol | 76.09 | 0.3120 | 246 | 64.4 |
| 7 | Trimellitic anhydride | 192.13 | 0.01682 | 45.6 | 8.76 (1.50-wt %) |

Example 1

In this example, the cyclohexane dicarboxylic acid (CHDA) used in Comparative Example 1 was replaced with camphoric acid, with no other formulation changes. The resin was about 70% bio-based.

A 1 liter Parr Bench Top Reactor was fitted with a short path condenser, nitrogen inlet, and magnetic stir shaft connected to a controller. The vessel was charged with about 215 grams (about 1472 mmol) of IS, about 172.2 grams (about 705 mmol) NDC, about 64.4 grams (about 846 mmol) propylene glycol, and about 0.596 grams (about 2.86 mmol) of butylstannoic acid catalyst (FASCAT® 4100, commercially available from Arkema). The vessel and contents were purged with nitrogen and heated so that the contents of the vessel reached about 150° C. over about 50 minutes. The stirrer was turned on once the vessel reached 150° C. and the temperature was increased to about 210° C. over a period of about 2 hours. By the time the temperature of the vessel reached 210° C., polycondensation of the reactant diols and diester had begun. Approximately 43 grams of distillate was collected. The vessel was left to heat overnight at about 200° C.

The next day, about 57.3 grams (about 101 mmol) of a dimer diacid, commercially available as PRIPOL® 1012 from Croda, and about 87 grams (about 434 mmol) of camphoric acid were charged into the vessel. The temperature was increased to about 210° C. and about 83 grams of distillate was collected after about 4 hours of heating. The vacuum receiver was then attached to the vacuum pump via a hose and the pressure in the reaction vessel was lowered from atmospheric to about 0.02 Torr over a period of about 11 hours, while collecting additional distillate (a total of about 101.3 grams).

The reaction continued over about 11 hours under vacuum to increase molecular weight, as checked by the softening point value as described in Comparative Example 1. Once the appropriate softening point was reached, the reaction was terminated by achieving atmospheric pressure. The temperature was decreased to about 190° C. and about 8 grams of trimellitic anhydride (TMA) was added to the vessel. After reacting for about 1.5 hours at about 190° C., the polymer was discharged into an aluminum pan. After the polymer resin cooled to room temperature, the polymer was broken into small chunks with a chisel and a small portion was ground in a M20 IKA Werke mill.

The ground polymer was analyzed for molecular weight by gel permeation chromatography (GPC), glass transition temperature (Tg) by differential scanning calorimetry (DSC), viscosity by AR2000 rheometer, and acid value as described above in Comparative Example 1.

Table 2 below summarizes the reactants utilized to form the resin of Example 1.

TABLE 2

| | Reactant | MW | Eq. | Moles (mmol) | Reactant Mass (g) |
|---|---|---|---|---|---|
| 1 | Isosorbide | 146.1 | 0.5426 | 1472 | 215.0 |
| 2 | Dimethyl Napthalene-2,6-dicarboxylate | 244.2 | 0.2600 | 705 | 172.2 |
| 3 | FASCAT ® 4100 catalyst | 208.8 | 0.001053 | 2.86 | 0.596 |
| 4 | Camphoric acid | 200.33 | 0.1600 | 434 | 87 |
| 5 | Dimer Acid (PRIPOL ® 1012) | 565 | 0.0374 | 101 | 57.3 |
| 6 | Propylene Glycol | 76.09 | 0.3120 | 846 | 64.4 |
| 7 | Trimellitic anhydride | 192.13 | 0.0150 | 45.6 | 8.76 (1.34-wt %) |

Tables 3 and 4 below compare the properties of the resins of Comparative Example 1 and Example 1. Four samples of each were tested (A-D). Because of the lower reactivity of camphoric acid, when reaction conditions were similar, the resin of Comparative Example 1 had a lower molecular weight (and thus a lower Tg and softening point (Ts)).

TABLE 3

| Comparative Example 1 | | | | |
|---|---|---|---|---|
| Sample | A | B | C | F |
| Mw | 1981 | 2634 | 3139 | 3094 |
| Mn | 1294 | 1600 | 1830 | 1789 |
| PDI | 1.53 | 1.65 | 1.72 | 1.73 |
| Mz | 2968 | 408 | 4936.0 | 4885 |
| Mp | 1570 | 2499 | 2905 | 2807 |
| Tg (on) | 20.7 | 29.6 | 38.6 | 40.0 |
| Tg (mid) | 26.3 | 41.0 | 49.1 | 51.6 |
| Tg (off) | 31.8 | 52.4 | 59.7 | 63.3 |
| Ts | 95.7 | 102.1 | 105.1 | 405.8 |
| AV | 8.83 | 4.44 | 2.38 | 12.46 |
| C/O | 3.98 | | | |
| COOH:OH (1:x) | 1.19 | | | |

Mw = weight average molecular weight
Mn = number average molecular weight
PDI = polydispersity (Mw/Mn)
Mz = z-average molecular weight
Mp = melting point
Tg (on) = Glass transition temperature (onset)
Tg (mid) = Glass transition temperature (mid-point)
Tg (off) = Glass transition temperature (offset)
Ts = softening point
AV = acid value
C/O = carbon to oxygen ratio
COOH:OH (1:x) = ratio of carboxyl to hydroxyl

TABLE 4

| Example 1 | | | | |
|---|---|---|---|---|
| Sample | A | C | F | After trimellitic anhydride addition |
| Mw | 2094 | 5410 | 5646 | 5179 |
| Mn | 1122 | 2037 | 2867 | 2475 |
| PDI | 1.87 | 2.21 | 1.97 | 2.09 |
| Mz | 3299 | 7476 | 9352 | 8532 |
| Mp | 1979 | 4337 | 5304 | 4972 |
| Tg (on) | 18.5 | 52.7 | 57.8 | 58.9 |
| Tg (mid) | 30.2 | 64.8 | 70.2 | 71.3 |
| Tg (off) | 42.0 | 76. | 82.5 | 84.0 |
| Ts | 100.9 | 122.4 | 127.6 | 130.0 |
| AV | 3.01 | 0.88 | 0.88 | 11.05 |
| C/O | 3.70 | | | |
| COOH:OH (1:x) | 1.18 | | | |

The resin of Example 1 was also compared with the resin of Comparative Example 1 and some other representative resins. The representative resins included a known bio-based resin, BIOREZ® 64-113, commercially available from Advanced Image Resources; a high molecular weight amorphous resin having a Mw of about 63,400 g/mol including alkoxylated bisphenol A with terephthalic acid, trimellitic acid, and dodecenylsuccinic acid co-monomers (hereinafter "High Mw Amorphous Resin"); a lower molecular weight amorphous resin having a Mw of about 16,100 including an alkoxylated bisphenol A with terephthalic acid, fumaric acid, and dodecenylsuccinic acid co-monomers (hereinafter "Low Mw Amorphous Resin"); and a resin having a Mw of about 3500 and Ts of about 103° C. including isosorbide, a dimer diacid, 1,4-cyclohexane dicarboxylic acid, dimethyl napthalene-2,6-dicarboxylate and 1,3-propanediol co-monomers comparable to the resin of Example 1 (referred to herein as a "lower viscosity resin").

FIG. 1 is a graph comparing the rheological behavior of the resin of Example 1 with the resin of Comparative Example 1, the High Mw Amorphous Resin, the Low Mw Amorphous Resin, the BIOREZ® 64-113, and the lower viscosity resin. As can be seen in FIG. 1, the resin of Example 1 was more viscous, though not as viscous as BIOREZ® 64-113 and the Low MW Amorphous Resin. These viscosity differences reflected differences in molecular weight and softening point more than formulation.

Comparative Example 2

A control bio-based resin, that was about 46% bio-based, was made using propylene glycol. A 1 liter volume, Parr Bench Top Reactor, was fitted with a short path condenser, nitrogen inlet, and magnetic stir shaft connected to a controller. The vessel was charged with about 59.1 grams (about 222 mmol) dodecenyl succinic anhydride, about 316.8 grams (about 4162.5 mmol) propylene glycol, about 287.4 grams (about 1480 mmol) dimethyl terephthalate, and about 1.1 grams (about 5.18 mmol) of a butylstannoic acid catalyst (FASCAT® 4100, commercially available from Arkema).

The vessel and its contents were purged with nitrogen and heated so that the contents of the vessel reached about 120° C. over a period of about 50 minutes. The temperature was increased at a rate of about 2.5° C./minute. The stirrer was turned on once the vessel reached about 163° C., after which the temperature was increased to about 200° C. over a period of about 4.5 hours. By the time the temperature of the vessel reached 170° C., polycondensation of the reactant diols and diester had begun. Approximately 88.25 grams of methanol distillate was collected before the vacuum receiver was attached to the vacuum pump via a hose. Initially a low vacuum of greater than about 1 Torr was applied to the reactor for about 30 minutes, after which the pressure in the reaction vessel was lowered to about 0.4 Torr for about 3 hours while collecting a glycol distillate (a total of about 161.5 grams). At this point the softening point of the polymer was about 108.6° C. as measured by Dropping Point Cell (Mettler FP90 central processor with a Mettler FP83HT dropping point cell). The reactor temperature was reduced to about 185-190° C. and about 21.3 grams (about 111 mmol)) trimellitic anhydride (TMA) was added. The nitrogen purge was applied for about 2.5 hours, followed by low vacuum for about 10 minutes and then high vacuum for about 35 minutes.

Once the appropriate softening point was reached, the reaction was terminated by achieving atmospheric pressure and the polymer was discharged into an aluminum pan. After the polymer resin cooled to room temperature, it was broken into chunks and a small portion was ground in a M20 IKA Werke mill. The ground polymer was analyzed for molecular weight, glass transition temperature, viscosity, and acid value as described above in Comparative Example 1.

Table 5 below summarizes the reactants utilized to form the resin of Comparative Example 2.

TABLE 5

| Reactant | Mw | Eq | Moles (mmol) | Reactant Mass (g) |
|---|---|---|---|---|
| Dodecenyl succinic anhydride | 266.376 | 0.06 | 222 | 59.1 |
| Propylene glycol | 76.094 | 1.13 | 4162.5 | 316.8 |
| Dimethyl terephthalate (DMT) | 194.184 | 0.40 | 1480 | 287.4 |
| FASCAT ® 4100 (n-butyl stannoic acid) | 208.8 | 0.0014 | 5.18 | 1.10 |
| Trimellitic anhydride (TMA) | 192.1 | 0.03 | 111 | 21.3 |

Example 2

In this example, some of the dimethyl terephthalate (DMT) used in Comparative Example 2 was replaced with camphoric acid. The resin was about 62% bio-based.

A 1 liter volume, Parr Bench Top Reactor was fitted as described above in Comparative Example 2. The vessel was charged with about 58.7 grams (about 220 mmol) of dodecenyl succinic anhydride, about 316 grams (about 4150 mmol) propylene glycol, about 88 grams (about 441 mmol) camphoric acid, about 200 grams (about 1028 mmol) dimethyl terephthalate, and about 1.07 grams (about 5.14 mmol) of a butylstannoic acid catalyst (FASCAT® 4100, commercially available from Arkema). The vessel and contents were purged with nitrogen and heated so that the contents of the vessel reached about 150° C. over a period of about 50 minutes. The stirrer was turned on once the vessel reached about 157° C. and the temperature was increased to about 200° C. over a period of about 7.5 hours. By the time the temperature of the vessel reached about 200° C., polycondensation of the reactant diols and diester had begun. Approximately 74 grams of methanol distillate was collected. The vessel was left to heat overnight at about 190° C. under a nitrogen blanket.

The next day, the temperature of the reactor was increased to about 195° C. A vacuum receiver was then attached to the vacuum pump via a hose and the pressure in the reaction vessel was lowered from atmospheric to greater than about 1 Torr for a total of about 1.5 hours. The pressure in the reaction vessel was then further lowered to about 0.4 Torr for about 5 hours while collecting glycol distillate (a total of about 168.4 grams). The reactor temperature was decreased to about 195° C. overnight and kept under a nitrogen blanket.

The following day, the temperature was increased to about 205° C. and a high vacuum was again applied since the softening point of the resin was still less than about 110° C. After about 5 hours under vacuum, the softening point was measured to be 116.7° C. At this point the reactor temperature was decreased to about 170-175° C. and about 21.17 grams of citric acid (about 110 mmol) was added to the reactor. A low vacuum (>1 Torr) was applied to the reactor for about 1.5 hours. The reaction was then terminated by achieving atmospheric pressure and the polymer was discharged into an aluminum pan. After the polymer resin cooled to room temperature, it was broken into small chunks with a chisel and a small portion was ground in a M20 IKA Werke mill. The ground polymer was analyzed for molecular weight, glass transition temperature, viscosity, and acid value as described above in Comparative Example 1.

The final softening point of this resin decreased from 116.7° C. to 109.2° C., due to hydrolysis after the addition of citric acid.

Table 6 below summarizes the reactants utilized to form the resin of Example 2.

TABLE 6

| Reactant | Mw | Eq | Moles (mmol) | Reactant Mass (g) |
|---|---|---|---|---|
| Dodecenyl succinic anhydride | 266.376 | 0.06 | 222 | 58.7 |
| Propylene glycol | 76.094 | 1.13 | 4150 | 316 |
| Camphoric acid | 200.232 | 0.12 | 441 | 88 |
| Dimethyl terephthalate (DMT) | 194.184 | 0.28 | 1028 | 200 |
| FASCAT ® 4100 (n-butyl stannoic acid) | 208.8 | 0.0014 | 5.14 | 1.074 |
| Citric acid | 192.124 | 0.03 | 110 | 21.17 |

Table 7 below compares the properties of the resins of Comparative Example 2 and Example 2. Because of the lower reactivity of camphoric acid, when reaction conditions were similar, Example 2 (VF637) had a lower molecular weight (and thus a lower Tg and softening point).

TABLE 7

| ID | C/O | % Bio-content | $Tg_{(on)}$ | Ts (° C.) | Acid Value | GPC Mw | GPC Mn |
|---|---|---|---|---|---|---|---|
| Comparative Example 2 | 2.87 | 34.0 | 65.5 | 118.7 | 29.4 | 8960 | 3112 |
| Example 2 | 2.26 | 48.0 | 49.6 | 109.2 | 38.2 | 14192 | 4844 |

The resin of Example 2 was compared with the resin of Comparative Example 2 and some other representative resins. The representative resins included a known bio-based resin, BIOREZ® 64-113, commercially available from Advanced Image Resources; a high molecular weight amorphous resin having a Mw of about 63,400 g/mol including alkoxylated bisphenol A with terephthalic acid, trimellitic acid, and dodecenylsuccinic acid co-monomers (hereinafter "High MW Amorphous Resin"); a lower molecular weight amorphous resin having a Mw of about 16,100 including an alkoxylated bisphenol A with terephthalic acid, fumaric acid, and dodecenylsuccinic acid co-monomers (hereinafter "Low MW Amorphous Resin").

Figure 2:
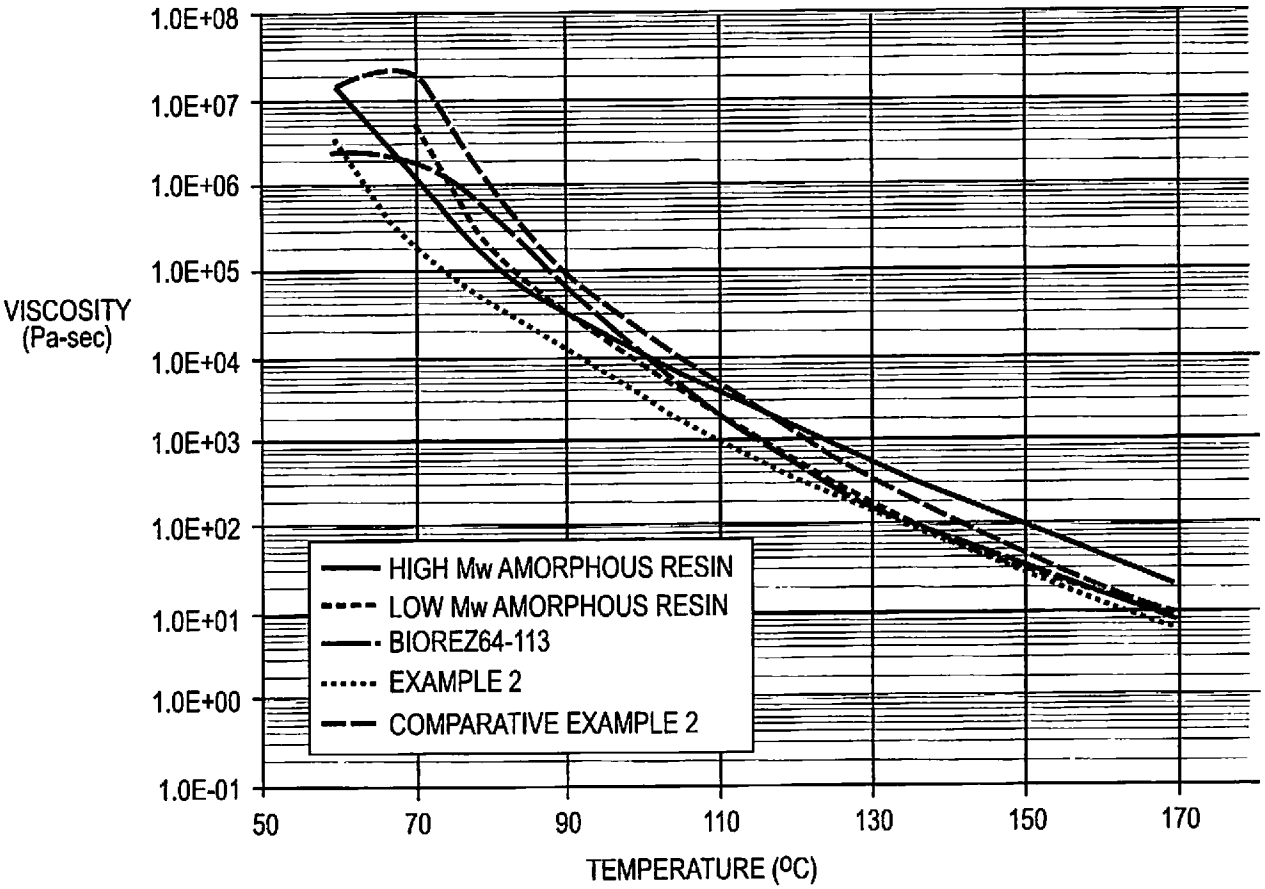
FIG. 2 is a graph depicting the rheological temperature profile of another resin of the present disclosure compared with other resins.

FIG. 2 is a graph comparing the rheological behavior of Example 2 relative to the resin of Comparative Example 2, the High Mw Amorphous Resin, the Low Mw Amorphous Resin, and BIOREZ® 64-113. Despite its lower softening point and Tg, the resin of Example 2 had comparable rheological behavior to the Low MW Amorphous Resin at typical fusing temperatures.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

a bio-based amorphous polyester resin, wherein the bio-based amorphous polyester resin is a reaction product of a polycondensation reaction, wherein reactants of said reaction comprise a camphoric acid and at least one diol, wherein the camphoric acid is present in an amount from 1% by weight to 60% by weight of the total amount of reactants in said reaction to form the bio-based amorphous polyester resin;

optionally, at least one crystalline polyester resin; and optionally, one or more ingredients selected from the group consisting of colorants, waxes, coagulants, and combinations thereof, wherein the bio-based amorphous polyester resin is present in the toner in an amount from 20 to 80 percent by weight of toner components.

2. The toner of claim 1, wherein said reactants further comprise D-isosorbide, naphthalene dicarboxylate, azelaic acid, cyclohexane-1,4-dicarboxylic acid, succinic acid, dodecenyl succinic anhydride, dimethyl terephthalate, dimer acid, propylene glycol, ethylene glycol or combinations thereof.

3. The toner of claim 1, wherein said reactants further comprise D-isosorbide in an amount from 2% by weight to 60% by weight of the total amount of reactants, dimethyl naphthalene 2,6-dicarboxylate in an amount from 2% by weight to 50% by weight of the total amounts of reactants, dimer acid in an amount of from 0.02% by weight to 50% by weight of the total amount of reactants and propylene glycol in an amount from 5% by weight to 50% by weight of the total amount of reactants.

4. The toner of claim 1, wherein said reactants further comprise dodecenyl succinic anhydride in an amount from 2% by weight to 40% by weight of the total amount of reactants, dimethyl terephthalate in an amount from 2% by weight to 50% by weight of the total amount of reactants and propylene glycol in an amount from 5% by weight to 50% by weight of the total amount of reactants.

5. The toner of claim 1, wherein the bio-based amorphous polyester resin possesses a glass transition temperature of from 25° C. to 90° C., and a softening point of from 90° C. to 140° C.

6. The toner of claim 1, wherein the bio-based amorphous polyester resin possesses a weight average molecular weight of from 1,500 g/mol to 100,000 g/mol, and a number average molecular weight from 1,000 g/mol to 50,000 g/mol.

7. The toner of claim 1, wherein the bio-based amorphous polyester resin has a carbon to oxygen ratio of from 1.5 to 7, and an acid value of from 7 mg KOH/g of resin to 25 mg KOH/g of resin.

8. The toner of claim 1, wherein the bio-based amorphous polyester resin possesses a $^{14}C/^{12}C$ molar ratio from $0.5\times10^{-12}$ to $1\times10^{-12}$.

9. The toner composition of claim 1, wherein the bio-based amorphous polyester resin is present in an amount from 30 percent by weight of the toner to 60 percent by weight of the toner.

10. The toner of claim 1, wherein the bio-based amorphous polyester resin possesses a glass transition temperature of from 30° C. to 70° C., and a softening point of from 100° C. to 130° C.

11. The toner of claim 1, wherein the bio-based amorphous polyester resin possesses a weight average molecular weight of from 3,000 g/mol to 20,000 g/mol, and a number average of molecular weight from 2,000 g/mol to 15,000 g/mol.

12. The toner of claim 1, wherein the bio-based amorphous polyester resin has a carbon to oxygen ratio of from 1.5 to 7, an acid value from 7 mg KOH/g of resin to 25 mg KOH/g of resin, and wherein the bio-based amorphous polyester resin possesses a $^{14}C/^{12}C$ molar ratio from $0.5\times10^{-12}$ to $1\times10^{-12}$.

13. The toner of claim 1, wherein the bio-based amorphous polyester resin possesses a glass transition temperature of from 25° C. to 90° C., a softening point of from 90° C. to 140° C., a weight average molecular weight of from 1,500 g/mol to 100,000 g/mol, a number average molecular weight from 1,000 g/mol to 50,000 g/mol, and wherein the bio-based amorphous polyester resin possesses a $^{14}C/^{12}C$ molar ratio from $0.5\times10^{-12}$ to $1\times10^{-12}$.

14. The toner of claim 1, wherein the bio-based amorphous polyester resin has a carbon to oxygen ratio of from 1.5 to 7, and an acid value of from 7 mg KOH/g of resin to 25 mg KOH/g of resin.

15. A toner comprising:

at least one bio-based amorphous polyester resin comprising camphoric acid, wherein the bio-based amorphous polyester is a reaction product of a polycondensation reaction, wherein reactants of said reaction comprise a camphoric acid and at least one diol, wherein the camphoric acid is present in an amount from 1% by weight to 60% by weight of the total amount of reactants in said reaction to form the at least one bio-based amorphous polyester resin;

optionally, at least one crystalline polyester resin; and optionally, one or more ingredients selected from the group consisting of colorants, waxes, coagulants, and combinations thereof;

wherein the at least one bio-based amorphous polyester resin possesses a $^{14}C/^{12}C$ molar ratio from about $0.5\times10^{-12}$ to about $1\times10^{-12}$.

16. The toner of claim 15, wherein the at least one bio-based amorphous polyester resin is formed from bio-based monomers wherein at least 45% to 100% of the monomer starting materials comprise said bio-based monomers.

17. A toner comprising:

at least one bio-based amorphous polyester resin that is formed from camphoric acid in combination with at least one other component selected from the group consisting of D-isosorbide, naphthalene dicarboxylate, azelaic acid, cyclohexane-1,4-dicarboxylic acid, succinic acid, dodecenyl succinic anhydride, dimethyl terephthalate, dimer acid, propylene glycol, ethylene glycol, and combinations thereof;

wherein the bio-based amorphous polyester is a reaction product of a polycondensation reaction, wherein reactants of said reaction comprise the camphoric acid and the at least one component selected from the group consisting of D-isosorbide, naphthalene dicarboxylate, azelaic acid, cyclohexane-1,4-dicarboxylic acid, succinic acid, dodecenyl succinic anhydride, dimethyl terephthalate, dimer acid, propylene glycol, ethylene glycol, and combinations thereof;

optionally, at least one crystalline polyester resin; and optionally, one or more ingredients selected from the group consisting of colorants, waxes, coagulants, and combinations thereof, wherein the at least one bio-based amorphous polyester resin is formed from bio-based monomers wherein at least 45% to 100% of the monomer starting materials comprise said bio-based monomers;

wherein the at least one bio-based amorphous resin has a carbon to oxygen ratio of from about 1.5 to about 7, an acid value of from about 7 mg KOH/g of resin to about 25 mg KOH/g of at least one bio-based amorphous polyester resin, and wherein the at least one bio-based amorphous resin possesses a $^{14}C/^{12}C$ molar ratio from about $0.5\times10^{-12}$ to about $1\times10^{-12}$.

18. A toner comprising:

at least one bio-based amorphous polyester resin that is formed from camphoric acid starting material in an amount from about 1% by weight to 60% by weight of the at least one bio-based amorphous polyester resin, in combination with at least one other component selected from the group consisting of D-isosorbide, naphthalene dicarboxylate, azelaic acid, cyclohexane-1,4-dicarboxylic acid, succinic acid, dodecenyl succinic anhydride, dimethyl terephthalate, dimer acid, propylene glycol, ethylene glycol, and combinations thereof;

at least one crystalline polyester resin; and one or more ingredients selected from the group consisting of colorants, waxes, coagulants, and combinations thereof, wherein the at least one bio-based amorphous polyester resin is formed from bio-based monomers in an amount of 45% by weight of the at least one bio-based amorphous polyester resin to 100% by weight of the at least one bio-based amorphous polyester resin;

wherein the at least one bio-based amorphous polyester resin possesses a glass transition temperature of from about 25° C. to about 90° C., a softening point of from about 90° C. to about 140° C., a weight average molecular weight of from about 1,500 g/mol to about 100,000 g/mol, a number average molecular weight from about 1,000 g/mol to about 50,000 g/mol, and wherein the at least one bio-based amorphous polyester resin possesses a $^{14}C/^{12}C$ molar ratio from about $0.5\times10^{-12}$ to about $1\times10^{-12}$.

* * * * *